US011569022B2

(12) United States Patent
Shimizu et al.

(10) Patent No.: US 11,569,022 B2
(45) Date of Patent: Jan. 31, 2023

(54) COIL COMPONENT

(71) Applicant: Murata Manufacturing Co., Ltd., Kyoto-fu (JP)

(72) Inventors: Noriko Shimizu, Nagaokakyo (JP); Gota Shinohara, Nagaokakyo (JP); Mikito Sugiyama, Nagaokakyo (JP); Mari Yonemura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 580 days.

(21) Appl. No.: 16/716,237

(22) Filed: Dec. 16, 2019

(65) Prior Publication Data

US 2020/0118733 A1 Apr. 16, 2020

Related U.S. Application Data

(63) Continuation of application No. PCT/JP2018/020494, filed on May 29, 2018.

(30) Foreign Application Priority Data

Jun. 19, 2017 (JP) ..... JP2017-119820

(51) Int. Cl.
*H01F 27/28* (2006.01)
*H01F 27/32* (2006.01)
(Continued)

(52) U.S. Cl.
CPC ..... *H01F 27/2823* (2013.01); *H01F 27/28* (2013.01); *H01F 27/32* (2013.01); *H01F 41/0206* (2013.01); *H01F 41/04* (2013.01)

(58) Field of Classification Search
CPC ..... H01F 27/2823; H01F 27/28; H01F 27/32; H01F 41/0206; H01F 41/04; H01F 3/14;
(Continued)

(56) References Cited

U.S. PATENT DOCUMENTS 6,153,443 A * 11/2000 Durlam ..... G11C 11/15 427/127
6,476,689 B1 * 11/2002 Uchida ..... H03H 7/0115 333/185
(Continued)

FOREIGN PATENT DOCUMENTS

JP 2006-261580 A 9/2006
JP 2008-053447 A 3/2008
(Continued)

OTHER PUBLICATIONS

T. Sun et al., "Substrate Embedded Thin-Film Inductors With Magnetic Cores for Integrated Voltage Regulators," in IEEE Transactions on Magnetics, vol. 53, No. 10, pp. 1-9, Oct. 2017, Art No. 8400809, doi: 10.1109/TMAG.2017.2710324. (Year: 2017).*
(Continued)

*Primary Examiner* — M Baye Diao
(74) *Attorney, Agent, or Firm* — Studebaker & Brackett PC

(57) ABSTRACT

A coil component includes a body and a coil conductor embedded in the body. The body includes a magnetic layer and a non-magnetic layer. The magnetic layer is formed of a composite material including a metal particle and a resin material, and the non-magnetic layer is arranged to block between at least one of top and bottom surfaces of the body and the coil conductor.

20 Claims, 7 Drawing Sheets

(51) Int. Cl.
*H01F 41/02* (2006.01)
*H01F 41/04* (2006.01)

(58) Field of Classification Search
CPC ..... H01F 27/292; H01F 27/2847; H01F 2017/048; H01F 17/04
USPC ..... 336/221
See application file for complete search history.

(56) References Cited

U.S. PATENT DOCUMENTS

| | | | | |
|---|---|---|---|---|
| 7,304,557 | B2 * | 12/2007 | Tsuzuki | H01F 17/0006 336/200 |
| 11,087,914 | B2 * | 8/2021 | Yokoyama | H01F 17/0013 |
| 2011/0285215 | A1 * | 11/2011 | Hatase | H01F 27/2871 333/167 |
| 2017/0025220 | A1 * | 1/2017 | Nakaniwa | H01F 27/2804 |
| 2017/0301451 | A1 * | 10/2017 | Kim | H01F 41/061 |
| 2018/0241126 | A1 * | 8/2018 | Nomura | H01Q 7/06 |

FOREIGN PATENT DOCUMENTS

| | | | | | |
|---|---|---|---|---|---|
| JP | 2012-089765 | A | | 5/2012 | |
| JP | 2015-065363 | A | | 4/2015 | |
| JP | 2015-079931 | A | | 4/2015 | |
| JP | 2016-076559 | A | | 5/2016 | |
| JP | 2017-076735 | A | | 4/2017 | |
| JP | 2017-098326 | A | | 6/2017 | |
| JP | 2017-103357 | A | | 6/2017 | |
| KR | 20070032275 | A | * | 3/2007 | H01F 3/14 |

OTHER PUBLICATIONS

Y. Fukuda, T. Inoue, T. Mizoguchi, S. Yatabe and Y. Tachi, "Planar inductor with ferrite layers for DC-DC converter," in IEEE Transactions on Magnetics, vol. 39, No. 4, pp. 2057-2061, Jul. 2003, doi: 10.1109/TMAG.2003.812708. (Year: 2003).*

International Search Report issued in PCT/JP2018/020494; dated Aug. 28, 2018.

Written Opinion issued in PCT/JP2018/020494; dated Aug. 28, 2018.

* cited by examiner

COIL COMPONENT

CROSS-REFERENCE TO RELATED APPLICATIONS

This application claims benefit of priority to International Patent Application No. PCT/JP2018/020494, filed May 29, 2018, and to Japanese Patent Application No. 2017-119820, filed Jun. 19, 2017, the entire contents of each are incorporated herein by reference.

BACKGROUND

Technical Field

The present disclosure relates to a coil component, and more specifically to a coil component including a body and a coil conductor embedded in the body.

Background Art

Conventionally, a coil component has been used as a power inductor in a DC/DC converter circuit or the like. Because of a reduction in size and an increase in current of electronic equipment in recent years, power inductors also require a reduction in size and an increase in current. As a small-sized inductor, a ferrite inductor that uses a ferrite material for a magnetic layer is known, but, because the ferrite inductor does not have sufficient DC superposition characteristics, is not suitable in some cases for use in equipment in which a large current is applied. Thus, in recent years, metal inductors that are excellent in DC superposition characteristics have been developed energetically, as described, for example, in Japanese Patent Application Laid-Open No. 2015-79931.

SUMMARY

However, a conventional metal inductor described in Japanese Patent Application Laid-Open No. 2015-79931, i.e., a coil component including a body including a metal magnetic body and a coil conductor embedded in the body, cannot necessarily be said to be sufficient in order to meet gradually increasing demand of increasing the DC superposition characteristics.

Accordingly, the present disclosure provides a coil component including a magnetic layer formed of a composite material including a metal material and a resin material, the coil component having favorable DC superposition characteristics.

The present inventors have made a diligent study to further increase DC superposition characteristics in a coil component that uses a metal magnetic body, have eventually found that high DC superposition characteristics can be obtained when a non-magnetic layer is provided in a body of a coil component, and have arrived at the present disclosure.

According to the gist of the present disclosure, there is provided a coil component including a body and a coil conductor embedded in the body, in which the body includes a magnetic layer and a non-magnetic layer. The magnetic layer is formed of a composite material including a metal particle and a resin material, and the non-magnetic layer is arranged to block between at least one of top and bottom surfaces of the body and the coil conductor.

According to the present disclosure, there can be provided a coil component having excellent DC superposition characteristics such that, in the coil component including a body including a magnetic layer formed of a composite material including a metal particle and a resin material, and a coil conductor embedded in the body, a non-magnetic layer is arranged between at least one of top and bottom surfaces of the body and the coil conductor.

DETAILED DESCRIPTION

The coil component of the present disclosure is described in detail with reference to the drawings. However, the shape, the arrangement, and the like of constituent elements of the coil component of the present embodiment are not limited to the illustrated examples.

Figure 1:
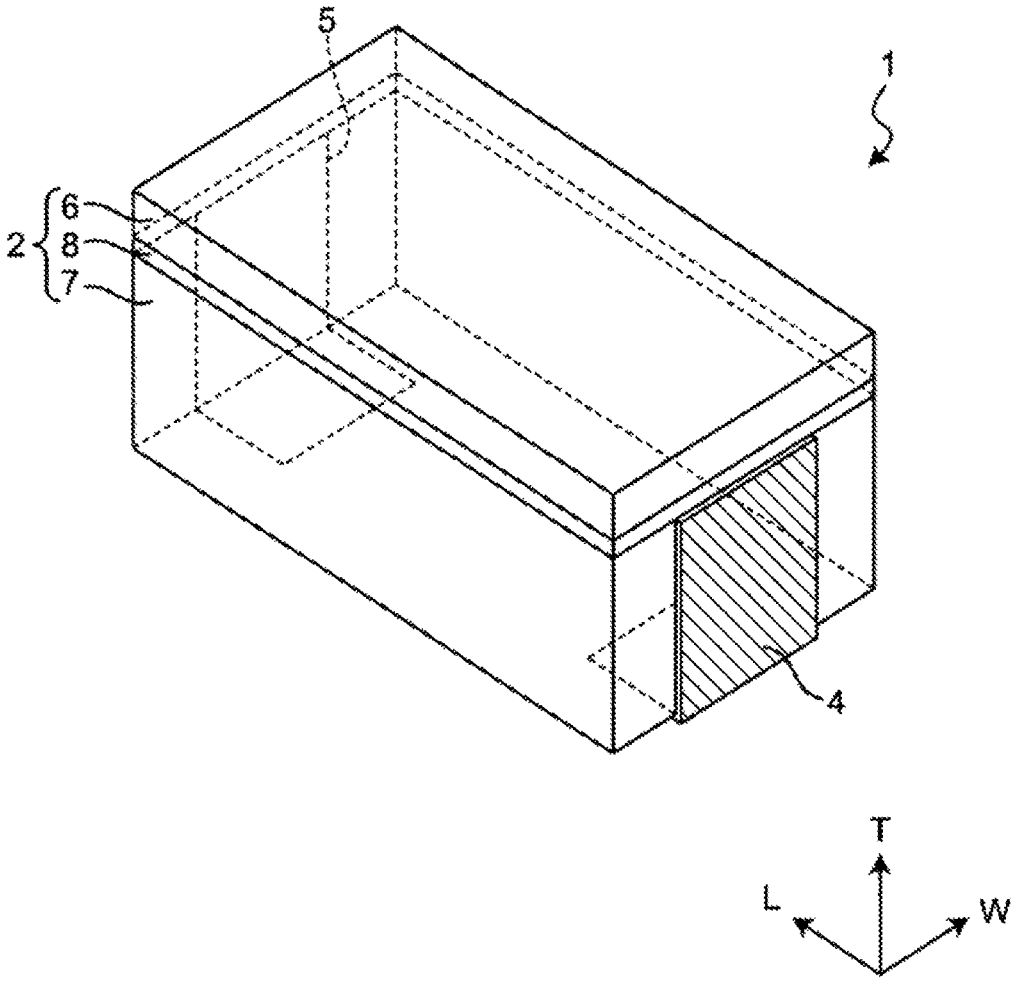
FIG. 1 is a perspective view schematically illustrating an embodiment of a coil component of the present disclosure.
Figure 2:
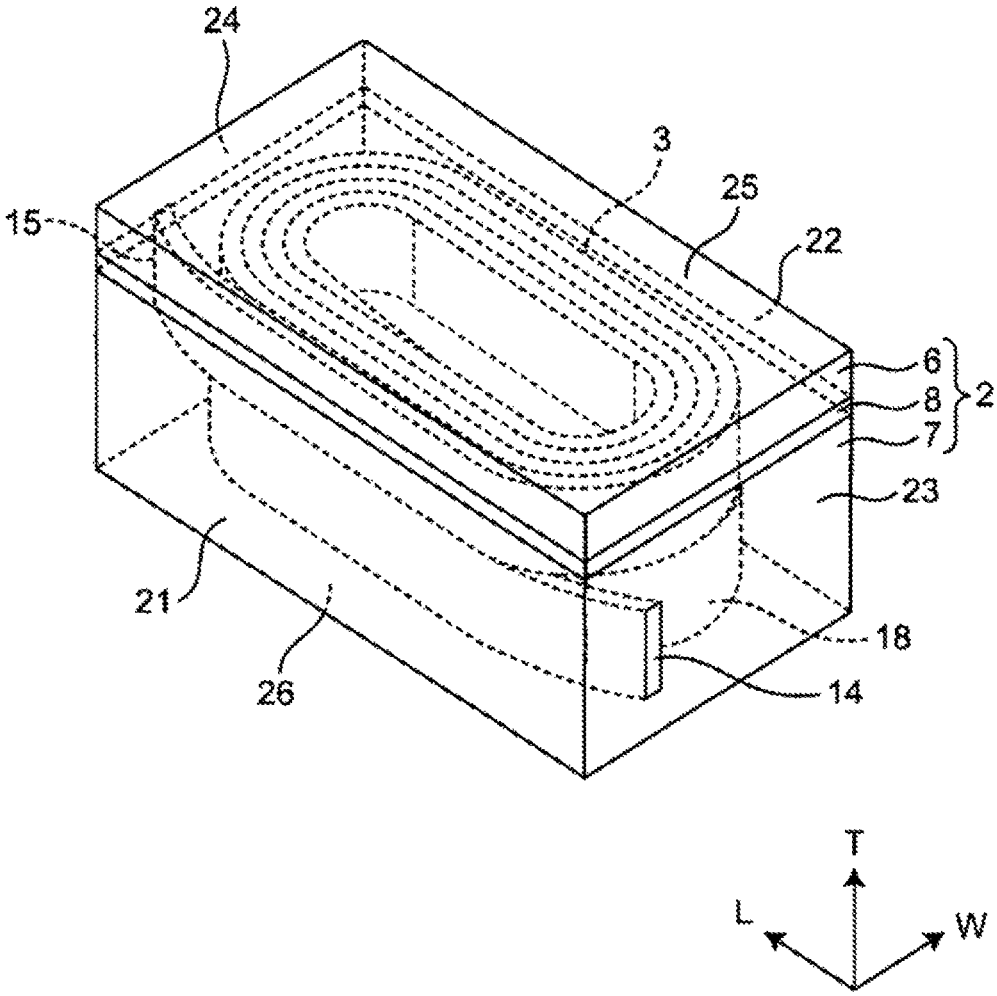
FIG. 2 is a perspective view of the coil component illustrated in FIG. 1 without an outer electrode.
Figure 3:
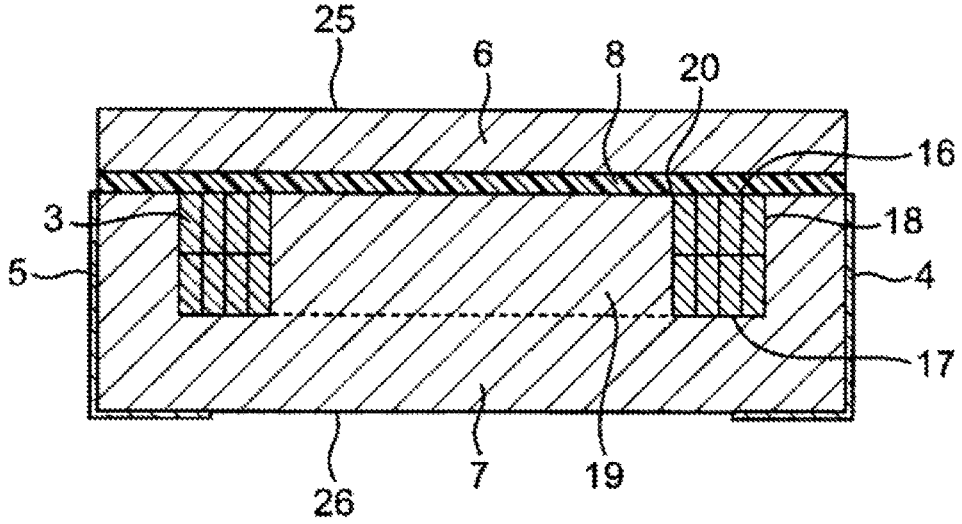
FIG. 3 is a cross-sectional view schematically illustrating a cross-section parallel to an LT plane of the coil component illustrated in FIG. 1.

A perspective view of a coil component 1 of the present embodiment is schematically illustrated in FIG. 1, a perspective view of a body 2 of the coil component 1 is illustrated in FIG. 2, and a cross-sectional view of the coil component 1 is illustrated in FIG. 3.

As illustrated in FIGS. 1 to 3, the coil component 1 of the present embodiment has a substantially rectangular parallelepiped shape. The coil component 1 substantially includes the body 2, the coil conductor 3 embedded in the body 2, and outer electrodes 4 and 5. Here, regarding the body 2, the right and left side surfaces in the drawing of FIG. 3 are called "end surfaces," the upper side surface in the drawing is called a "top surface," the lower side surface in the drawing is called a "bottom surface," the front side surface in the drawing is called a "front surface," and the back side surface in the drawing is called a "back surface." Moreover, the end surfaces, the front surface, and the back surface are also simply called "side surfaces." The aforementioned body 2 includes a magnetic layer 6 positioned in an upper part of the body 2, a magnetic layer 7 positioned in a lower part, and a non-magnetic layer 8 positioned between the magnetic layers 6 and 7. A coil conductor 3 is embedded in the body 2. Here, regarding the coil conductor, a surface following a winding direction of a winding is called a "side surface" of the coil conductor, and a surface following a thickness direction of the winding is called an "end surface." In the present embodiment, a surface parallel to the axis of the coil conductor, i.e., a surface formed of the main surface of a flat wire present on the outermost layer of the coil conductor is the side surface, and a surface perpendicular to the axis of the coil conductor, i.e., a surface formed of the side surface of flat wire in each layer is the end surface. Moreover, the outer electrodes 4 and 5 are provided on the magnetic layer 7 of both end surfaces 23 and 24 of the body 2. The outer electrodes 4 and 5 are extended from the end surfaces 23 and 24 to a part of a bottom surface 26. That is, the outer electrodes 4 and 5 are an L-shaped electrode. Terminal ends 14 and 15 of the aforementioned coil conductor 3 are respectively electrically connected to the outer electrodes 4 and 5 on the end surfaces 23 and 24 of the body 2.

In the present specification, the length of the coil component 1 is called "L," the width is called "W," and the thickness (height) is called "T" (see FIGS. 1 and 2). In the present specification, a plane parallel to the front surface and the back surface is called an "LT plane," a plane parallel to the end surface is called a "WT plane," and a plane parallel to the top surface and the bottom surface is called an "LW plane."

As described above, in the present embodiment, the body 2 includes the magnetic layers 6 and 7 and the non-magnetic layer 8.

The aforementioned magnetic layer has relative permeability of 15 or more, preferably 20 or more, more preferably 30 or more.

The aforementioned magnetic layer is formed of a composite material of a metal particle and a resin material.

A metal magnetic material forming the aforementioned metal particle includes, but is not particularly limited to, any material having magnetism, e.g., iron, cobalt, nickel, gadolinium, or an alloy including one or two or more of them. Preferably, the aforementioned metal magnetic material is iron or iron alloy. Iron may be iron itself, but may be an iron derivative, e.g., a complex. The iron derivative includes, but is not particularly limited to, carbonyl iron, which is a complex of iron and CO, preferably pentacarbonyl iron. In particular, hard grade carbonyl iron (e.g., hard grade carbonyl iron manufactured by BASF SE) having an onion skin structure (a structure forming a concentric spherical layer from the center of the particle) is preferable. The iron alloy includes, but is not particularly limited to, Fe—Si-based alloy, Fe—Si—Cr-based alloy, and Fe—Si—Al-based alloy. The aforementioned alloy may further include B, C, and the like as other subcomponents. The content of the subcomponent can be, but is not particularly limited to, for example, 0.1 mass % or more to 5.0 mass % or less (i.e., from 0.1 mass % to 5.0 mass %), preferably 0.5 mass % or more to 3.0 mass % or less (i.e., from 0.5 mass % to 3.0 mass %). The aforementioned metal magnetic material may be one type only or may be two or more types.

In a preferable aspect, the aforementioned metal particle has an average particle size of preferably 0.5 μm or more to 10 μm or less (i.e., from 0.5 μm to 10 μm), more preferably 1 μm or more to 5 μm or less (i.e., from 1 μm to 5 μm), further preferably 1 μm or more to 3 μm or less (i.e., from 1 μm to 3 μm). When the average particle size of the aforementioned metal particle is 0.5 μm or more, the metal particle becomes easy to handle. Moreover, when the average particle size of the aforementioned metal particle is 10 μm or less, the filling rate of the metal particle can be further increased, increasing the magnetic characteristics of the magnetic layer.

Here, the aforementioned average particle size means an average of an equivalent circle size of the metal particle in an SEM (scanning electron microscope) image of a cross section of the magnetic layer. For example, the aforementioned average particle size can be obtained in such a manner that a cross section obtained through cutting of the coil component 1 is captured by SEM in a plurality of (e.g., five) regions (e.g., 130 μm×100 μm), the SEM image is analyzed with image analysis software (e.g., A-Zo Kun (registered trademark) manufactured by Asahi Kasei Engineering Corporation) to determine the equivalent circle size for 500 or more metal particles, and the average is calculated.

In a preferable aspect, the surface of the aforementioned metal particle may be covered with a coating of an insulation material (hereinafter also simply called the "insulation coating"). In this aspect, it is sufficient if the surface of the metal particle is covered with the insulation coating to such an extent that the insulation property between the particles can be increased. That is, the surface of the metal particle may be covered with the insulation coating only with respect to a portion of the surface of the metal particle or may be covered over the entire surface. Moreover, the shape of the insulation coating is not particularly limited, but may be a mesh shape or a layered shape. In a preferable aspect, the aforementioned metal particle is covered with the insulation coating with respect to the region for 30% or more of the surface, preferably 60% or more, more preferably 80% or more, further preferably 90% or more, most preferably 100%. Covering the surface of the metal particle with the insulation coating can increase the resistivity in the magnetic layer.

The thickness of the aforementioned insulation coating can be, but is not particularly limited to, preferably 1 nm or more to 100 nm or less (i.e., from 1 nm or more to 100 nm), more preferably 3 nm or more to 50 nm or less (i.e., from 3 nm to 50 nm), further preferably 5 nm or more to 30 nm or less (i.e., from 5 nm to 30 nm), for example, 10 nm or more to 30 nm or less (i.e., from 10 nm to 30 nm) or 5 nm or more to 20 nm or less (i.e., from 5 nm to 20 nm). An increase in thickness of the insulation coating can further increase the resistivity of the magnetic layer. Moreover, a reduction in thickness of the insulation coating can further increase the amount of metal particles in the magnetic layer, increasing the magnetic characteristics of the magnetic layer, facilitating a reduction in size of the magnetic layer.

The aforementioned resin material includes, but is not particularly limited to, thermosetting resin, e.g., epoxy resin, phenolic resin, polyester resin, polyimide resin, or polyolefin resin. The resin material may be one type only or may be two or more types.

In the aforementioned aspect, the content of the metal particle in the magnetic layer relative to the entire magnetic layer can be preferably 80 mass % or more, more preferably 90 mass % or more, further preferably 95 mass % or more. Moreover, the content of the metal particle in the magnetic layer can be, although the upper limit is not particularly limited, relative to the entire magnetic layer, preferably 98 mass % or less.

The filling rate of the metal particle in the magnetic layer can be preferably 50% or more, more preferably 65% or more, further preferably 75% or more, yet more preferably 85% or more. Moreover, although the upper limit of the filling rate of the metal particle in the magnetic layer is not particularly limited, the filling rate can be 98% or less, 95% or less, 90% or less, or 80% or less. An increase in filling rate of the metal particle in the magnetic layer increases the magnetic permeability of the magnetic layer, and higher inductance can be obtained.

Here, the aforementioned filling rate means a rate of an area of the metal particle in the SEM image of the cross section of the magnetic layer. For example, the aforementioned filling rate can be obtained in the following manner:

the coil component 1 is cut near a central part of the product with a wire saw (DWS3032-4 manufactured by Meiwafosis Co., Ltd.) to expose the substantially central part on the LT plane. Ion milling is carried out on the resultant cross-section (ion milling apparatus IM4000 manufactured by Hitachi High-Technologies Corporation) to remove shear drop due to the cutting to obtain a cross-section for observation. A predetermined region (e.g., 130 μm×100 μm) of a plurality of points (e.g., five points) of the cross section is captured with a SEM, and the SEM image is analyzed with image analysis software (e.g., A-Zo Kun (registered trademark) manufactured by Asahi Kasei Engineering Corporation) to determine the rate of the area of the metal particle in the region.

In an aspect, the aforementioned magnetic layer may further include other substance particles. Including particles of other substances enables adjustment of fluidity during manufacture of the magnetic layer.

In the present specification, the "non-magnetic body" is not limited to a substance having relative permeability of 1, but includes a substance having relatively small relative permeability.

The aforementioned non-magnetic layer has relative permeability of less than 15, preferably 10 or less, more preferably 5 or less, further preferably 2 or less. A difference in relative permeability between the non-magnetic layer and the magnetic layer is, for example, 10 or more.

The aforementioned non-magnetic layer is formed of a non-magnetic material. Note that the non-magnetic layer, as long as it satisfies the aforementioned relative permeability, may include a metal magnetic material or a magnetic ferrite.

The non-magnetic material includes, but is not particularly limited to, a resin material, non-magnetic inorganic material, or the like.

The aforementioned resin material includes the same resin material as that used in the aforementioned magnetic layer, specifically thermosetting resin, e.g., epoxy resin, phenolic resin, polyester resin, polyimide resin, or polyolefin resin. The resin material may be one type only or may be two or more types.

In a preferable aspect, the resin material in the non-magnetic layer can be the same as the resin material for the magnetic layer. Use of the same resin material increases adhesion between the non-magnetic layer and the magnetic layer.

The aforementioned non-magnetic inorganic material includes an inorganic oxide, a non-magnetic ferrite material, or the like.

The aforementioned inorganic oxide includes aluminium oxide (typically, $Al_2O_3$), silicon oxide (typically, $SiO_2$), or zinc oxide (typically, ZnO).

The aforementioned non-magnetic ferrite material can be a complex oxide including two or more metals selected from Zn, Cu, Mn, and Fe.

In an aspect, the non-magnetic layer is formed of the resin material. Use of the resin material can increase adhesion between the non-magnetic layer and the magnetic layer.

In an aspect, the non-magnetic layer is formed of the non-magnetic inorganic material. Use of the non-magnetic inorganic material can increase the bending strength of the coil component.

In a preferable aspect, the non-magnetic layer is formed of the resin material and the non-magnetic inorganic material. In this aspect, the non-magnetic inorganic material has a particle shape. The particle of the non-magnetic inorganic material has an average particle size of preferably 0.5 μm or more to 10 μm or less (i.e., from 0.5 μm to 10 μm). Here, because the magnetic layer includes metal magnetic powder, a magnetic flux is generated when current flows in the coil, and eddy current occurs in the metal magnetic powder by the generated magnetic flux. The eddy current can generate loss due to heat, and heat can be generated in the magnetic layer. Here, when the non-magnetic layer formed of an insulator, e.g., the resin material and the non-magnetic inorganic material, is inserted, eddy current loss becomes less likely to occur in the non-magnetic layer, and the generation of heat in the coil component can be suppressed. Moreover, when the non-magnetic layer includes resin, adhesion with the magnetic layer that also includes resin can be increased, and separation can be suppressed. Furthermore, when the non-magnetic layer includes the non-magnetic inorganic material in addition to the resin, the linear expansion coefficient of the non-magnetic layer can be reduced, and, as compared with the case where the non-magnetic layer is formed solely of the resin, a change in thickness of the non-magnetic layer when heated can be reduced. When the linear expansion coefficient of the non-magnetic layer is large, the non-magnetic layer tends to be thick when heated, and the L value is likely to be reduced. In the present aspect, when the non-magnetic layer includes the non-magnetic inorganic material in addition to the resin, the linear expansion coefficient of the non-magnetic layer can be reduced and a reduction in L value can be suppressed. Moreover, when the non-magnetic layer includes the non-magnetic inorganic material in addition to the resin, the linear expansion coefficients of the non-magnetic layer and the magnetic layer can be the same such that separation between the non-magnetic layer and the magnetic layer can be suppressed. In this aspect, the non-magnetic inorganic material is preferably aluminium oxide. Mixing the resin material with the non-magnetic inorganic material, preferably inorganic oxide, particularly an aluminium oxide particle, increases the bending strength and the heat dissipation of the coil component.

In the aforementioned aspect, the content of the non-magnetic inorganic material in the non-magnetic layer relative to the entire non-magnetic layer can be 70 mass % or more. Moreover, the upper limit of the content of the non-magnetic inorganic material in the non-magnetic layer is not particularly limited, but can be preferably 98 mass % or less relative to the entire non-magnetic layer.

In the aforementioned aspect, the filling rate of the non-magnetic inorganic material in the non-magnetic layer can be preferably 40% or more. Moreover, although the upper limit of the filling rate of the non-magnetic inorganic material in the non-magnetic layer is not particularly limited, the filling rate can be 98% or less.

The thickness of the aforementioned non-magnetic layer is, although not particularly limited, for example, 10 μm or more. An increase in thickness of the non-magnetic layer can further increase the DC superposition characteristics of the coil component. Moreover, the thickness of the non-magnetic layer is, although not particularly limited, for example, 100 μm or less. A reduction in thickness of the non-magnetic layer can further increase the inductance of the coil component.

The body 2 includes the magnetic layer 7 and the non-magnetic layer 8, and the coil conductor 3 is embedded in the body 2. Because the non-magnetic layer 8 is included in the body 2, the density of the magnetic flux passing inside the body 2 can be reduced, and the DC superposition characteristics can be increased. In the aforementioned body 2, the non-magnetic layer 8 is sandwiched between the magnetic layers 6 and 7, and is exposed at all the four side surfaces of the body 2. In other words, the non-magnetic layer 8 is arranged to block between one end surface 16 of the coil conductor and the top surface 25 of the body. In yet other words, the non-magnetic layer 8 extends through the body 2 to separate the coil conductor 3 and the top surface 25 of the body 2. That is, in the body 2, there is no path that connects the end surface 16 of the coil conductor and the top surface 25 of the body without passing the non-magnetic layer 8. The non-magnetic layer 8 is arranged to block between the coil conductor 3 and the top surface 25 of the body such that the coil component can be an open magnetic circuit component and the magnetic flux can be intentionally flown to the outside of the coil component to increase the DC superposition characteristics. Moreover, in the present aspect, the non-magnetic layer 8 is not positioned in a portion of the body that is sandwiched by the coil conductors 3. In particular, the non-magnetic layer 8 is not positioned in a region that is sandwiched by the coil conductors 3 in the thickness direction of the body (T direction in FIG. 1). Thus, dispersion of the magnetic flux can be suppressed.

Note that as long as the position of the aforementioned non-magnetic layer 8 is arranged to block between at least one of the top and bottom surfaces 25 and 26 of the aforementioned body and the aforementioned coil conductor, its location and shape are not limited.

In an aspect, as illustrated in FIGS. 1 to 3, the non-magnetic layer 8 is arranged to contact the end surface 16 of the coil conductor. In this aspect, the non-magnetic layer is preferably arranged to block the magnetic path from the winding core portion of the coil conductor. In other words, the non-magnetic layer is arranged such that, at the end surface 16 of the coil conductor, the contact surface between the non-magnetic layer and the coil conductor surrounds the cavity of the coil conductor. When the non-magnetic layer is thus arranged to block an inner magnetic path of the coil conductor, the non-magnetic layer can be efficiently arranged at the cavity of the coil conductor where the magnetic flux tends to saturate, and the DC superposition characteristics can be increased. In particular, when the coil conductor is formed of a wound conductive wire, the magnetic flux does not pass through the conductive wire, but passes through the cavity of the coil conductor to go round the periphery of the coil conductor 3. Therefore, when the non-magnetic layer is arranged between the body and the coil conductor at the cavity of the coil conductor, the magnetic flux that passes through the cavity can be blocked efficiently, and the DC superposition characteristics can be increased. Note that the "winding core portion" means a portion inside the coil conductor, i.e., a portion surrounded by the coil conductor 3, and, in the coil component, the winding core portion is filled with the magnetic layer 7 or the non-magnetic layer 8.

In a preferable aspect, the non-magnetic layer 8 at least contacts an inner edge of the end surface 16 of the coil conductor. Here, the inner edge of the coil conductor means a boundary portion between the end surface of the coil conductor and the winding core portion. At the inner edge, particularly the magnetism tends to saturate, and therefore causing the non-magnetic layer to contact the inner edge of the end surface of the coil conductor can efficiently eliminate the magnetic saturation to further increase the DC superposition characteristics. The non-magnetic layer 8 preferably contacts the entire inner edge of the end surface 16 of the coil conductor.

In a more preferable aspect, the non-magnetic layer 8 covers the end surface 16 of the coil conductor. More preferably, the non-magnetic layer 8 covers the entire end surface 16 of the coil conductor. More preferably, the non-magnetic layer 8 contacts the entire end surface 16 of the coil conductor. When the non-magnetic layer contacts the entire end surface of the coil conductor, the magnetic path around the conductive wire that forms the coil conductor 3 can be blocked, further increasing the DC superposition characteristics.

Figure 4:
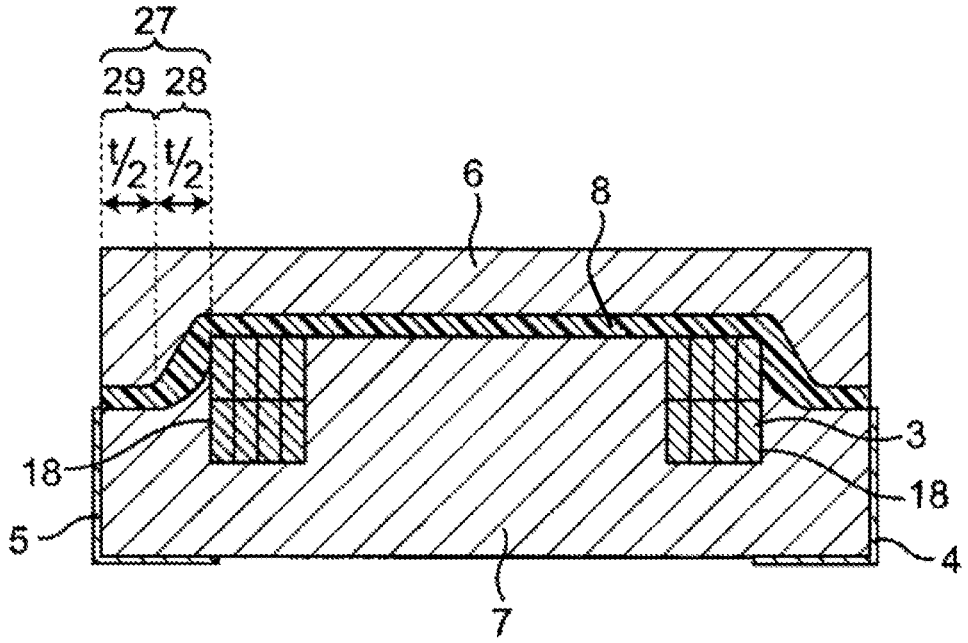
FIG. 4 is a cross-sectional view schematically illustrating a cross-section parallel to an LT plane of a coil component of the present disclosure according to another aspect.

In an aspect, as illustrated in FIG. 4, the non-magnetic layer 8 is present to go round the side surface 18 side from the end surface 16 of the coil conductor. When the non-magnetic layer goes round the side surface side of the coil conductor, the contact area between the non-magnetic layer and the magnetic layer is increased, increasing adhesion and enabling suppression of layer separation. Moreover, because the contact area between the non-magnetic layer and the coil conductor can be increased, use of a material having high heat dissipation for the non-magnetic layer can increase the heat dissipation of the coil component. Furthermore, when the non-magnetic layer goes round to cover the side surface of the coil conductor, the contact area between the coil conductor and the magnetic layer can be reduced, enabling suppression of short-circuit between the coil conductor and the metal particle in the magnetic layer.

In the aforementioned aspect, the non-magnetic layer 8 may go round entirely or partially in the length direction of the side surface 18 of the coil conductor. That is, in an aspect, the non-magnetic layer may go round to the half in the length direction of the side surface of the coil conductor. Note that, in this aspect, the "length direction" means the length direction of the coil conductor or, in other words, an axial direction of the coil conductor, i.e., an up-and-down direction in the drawing.

In an aspect, as illustrated in FIG. 4, a portion 27 of the non-magnetic layer 8 is positioned between the side surface of the coil conductor and the side surface of the body, and the average thickness of the non-magnetic layer 28 on the coil conductor side in a case where the portion 27 of the non-magnetic layer is divided into two on the side surface side of the coil conductor and the side surface side of the body is larger than the average thickness of the non-magnetic layer 29 on the side surface side of the body. When the average thickness of the non-magnetic layer 28 on the coil conductor side is larger, the thickness of the non-magnetic layer in the vicinity of the coil where the magnetic flux density can be higher is increased, and the DC superposition characteristics are further increased.

In this aspect, the average thickness of the non-magnetic layer 28 on the coil conductor side can be preferably 1.2 times or more, more preferably 1.5 times or more of the average thickness of the non-magnetic layer 29 on the side surface side of the body. Moreover, the average thickness of the non-magnetic layer 28 on the coil conductor side can be preferably 2.0 times or less of the average thickness of the non-magnetic layer 29 on the side surface side of the body.

In an aspect, as illustrated in FIGS. 1 to 3, the non-magnetic layer 8 is present on the top surface 25 side facing the bottom surface 26 on which the outer electrodes 4 and 5 are present. That is, the coil component includes the outer electrodes 4 and 5 on the bottom surface 26 of the body and the non-magnetic layer 8 between the top surface 25 and the coil conductor 3. When the non-magnetic layer is thus arranged on the side opposite the outer electrodes 4 and 5 across the coil conductor, the distance with respect to the outer electrodes, which are connections for a board or the like, becomes so far that the stress from the board is less likely to be applied to the interface between the non-magnetic layer and the magnetic layer, separation can be suppressed. In the present aspect, the magnetic layer 7 and the non-magnetic layer 8 are both formed of solidified resin, and are not integrated through sintering. Therefore, as compared with the ceramic coil component formed through sintering, there is a larger possibility that separation occurs at the interface of layers. However, when the non-magnetic layer is arranged on the side opposite the outer electrodes 4 and 5 across the coil conductor, even the coil component that includes the magnetic layer 7 and the non-magnetic layer 8 formed of solidified resin can suppress the separation.

In the present embodiment, as illustrated in FIGS. 2 and 3, the aforementioned coil conductor 3 is arranged such that the axis is oriented in an up-and-down direction of the body. The aforementioned coil conductor has two terminal ends 14 and 15, which are drawn to the end surfaces 23 and 24 of the body and are electrically connected to the outer electrodes 4 and 5.

The aforementioned conductive material includes, but is not particularly limited to, for example, gold, silver, copper, palladium, and nickel. Preferably, the conductive material is copper. The conductive material may be one type only or may be two or more types.

The aforementioned coil conductor 3 can be formed of a conductive wire or conductive paste, but is preferably formed of a conductive wire because the direct current resistance of the coil component can be reduced. The conductive wire may be a round wire or a flat wire, but is preferably a flat wire. Use of a flat wire facilitates winding of the conductive wire without gaps.

In an aspect, the conductive wire that forms the aforementioned coil conductor 3 may be covered with an insulation substance. Covering the conductive wire forming the coil conductor 3 with an insulation substance can further ensure insulation between the coil conductor and the magnetic layer. Note that, of course, the insulation substance is not present at a portion of the aforementioned conductive wire that is connected to the outer electrodes 4 and 5 such that the conductive wire is exposed.

The aforementioned insulation substance includes, but is not particularly limited to, for example, polyurethane resin, polyester resin, epoxy resin, polyamideimide resin, preferably polyamideimide resin.

As the aforementioned coil conductor 3, any type of coil conductor can be used, and a coil conductor, e.g., of a winding, edgewise winding, spiral winding, or helical winding, can be used. When the coil conductor 3 is formed of the conductive wire, a winding or edgewise winding is preferable in terms of a reduction in size of the component.

In an aspect, as illustrated in FIG. 2, the coil conductor 3 can be a coil conductor of a winding. In this aspect, the aforementioned non-magnetic layer 8 is preferably arranged parallel to the winding plane, for example, in FIG. 2, perpendicularly to the axis of the coil conductor. In this aspect, the non-magnetic layer is preferably arranged on the end surface of the coil conductor. When the non-magnetic layer is arranged to be parallel to the winding plane, the magnetic path generated perpendicularly to the winding plane can be efficiently blocked and the DC superposition characteristics can be increased. The winding plane is a plane on which the conductive wire is wound and is a surface perpendicular to the sheet of paper of FIG. 3. When the coil conductor is formed of a flat wire, the winding plane is a plane in which the flat wire is aligned in the thickness direction.

In a preferable aspect, the coil conductor 3 can be a coil conductor of an α-wound flat wire. In this aspect, the aforementioned non-magnetic layer 8 is preferably arranged substantially perpendicularly to the width direction of the flat wire (up-and-down direction in the sheet of paper of FIG. 3). In this aspect, the non-magnetic layer is preferably arranged on the end surface of the coil conductor. Here, substantial perpendicularity covers not only perfect perpendicularity, but also angles inclined to some extent from the perpendicularity for manufacturing reasons. For example, substantial perpendicularity can be an angle of 60° or more to 120° or less (i.e., from 60° to 120°), preferably 80° or more to 100° or less (i.e., from 80° to 100°). When the non-magnetic layer 8 is thus arranged substantially perpendicularly to the width direction of the flat wire, the magnetic path around the flat wire can be cut, and the DC superposition characteristics can be further increased.

In an aspect, the coil conductor 3 can be a coil conductor of edgewise winding. In this aspect, the aforementioned non-magnetic layer 8 is arranged so as to surface-contact the main surface of the conductive wire that forms the coil conductor at the end surface of the coil conductor. When the non-magnetic layer surface-contacts the conductive wire that forms the coil conductor, the heat dissipation of the coil component is increased.

In an aspect, the coil conductor 3 is arranged such that the distance from the top surface 25 of the body to one end surface 16 of the coil conductor is equal to the distance from the bottom surface 26 to the other end surface 17 of the coil conductor. Thus, the entire body makes a contribution to inductance more equally, increasing the inductance as a whole.

The aforementioned outer electrodes 4 and 5 are formed on predetermined points on the surface of the body so as to be electrically connected to the terminal ends 14 and 15 of the coil conductor 3, respectively.

In an aspect, as illustrated in FIGS. 1 and 3, the aforementioned outer electrodes 4 and 5 are formed in the form of an L-shaped electrode (two-face electrode) over the end surfaces 23 and 24 of the body 2 of the coil component 1, respectively, and the magnetic layer 7 at a part of the bottom surface 26. In another aspect, the outer electrodes 4 and 5 may be bottom surface electrodes formed only on the magnetic layer 7 at a part of the bottom surface 26 of the coil component 1. In cases where the aforementioned outer electrodes are formed as the L-shaped electrodes or the bottom surface electrodes on the magnetic layer 7, when the coil component is mounted on the board or the like, short-circuit with other components, e.g., a casing or a shield, positioned above can be prevented.

In yet another aspect, the outer electrodes 4 and 5 may be formed in the form of a five-face electrode on the end surfaces 23 and 24, the front surface 21, the back surface 22, the top surface 25, and the magnetic layer 7 at a part of the bottom surface 26 of the body 2 of the coil component 1.

The aforementioned outer electrodes are formed of the conductive material, preferably of one or more metal materials selected from Au, Ag, Pd, Ni, Sn, and Cu.

The aforementioned outer electrodes may be a single layer or a multilayer. In an aspect, when the outer electrodes are multilayers, the outer electrode can include a layer including Ag or Pd, a layer including Ni, or a layer including Sn. In a preferable aspect, the aforementioned outer electrodes are made of a layer including Ag or Pd, a layer including Ni, and a layer including Sn. Preferably, the aforementioned layers are provided in the order of the layer including Ag or Pd, the layer including Ni, and the layer including Sn from the coil conductor side. Preferably, the aforementioned layer including Ag or Pd can be a layer on which Ag paste or Pd paste has been baked (i.e., thermoset layer), and the aforementioned layer including Ni and the aforementioned layer including Sn can be a plating layer.

The thickness of the outer electrode can be, but is not particularly limited to, 1 μm or more to 20 μm or less (i.e., from 1 μm to 20 μm), preferably 5 μm or more to 10 μm or less (i.e., from 5 μm to 10 μm).

In another aspect, the coil component 1 may be covered with a protective layer excluding the outer electrodes 4 and 5. Providing the protective layer can prevent short-circuit with other electronic components in the case of mounting on the board or the like.

The insulation material forming the aforementioned protective layer includes resin materials with high electrical insulation property, e.g., acrylic resin, epoxy resin, or polyimide.

Next, a method for manufacturing the coil component 1 is described.

Figure 5A:
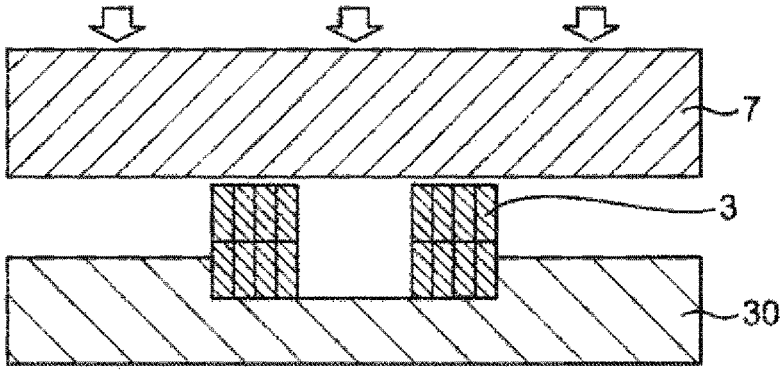
FIGS. 5A-5C are views for explaining a method for manufacturing a coil component of the present disclosure.
Figure 5B:
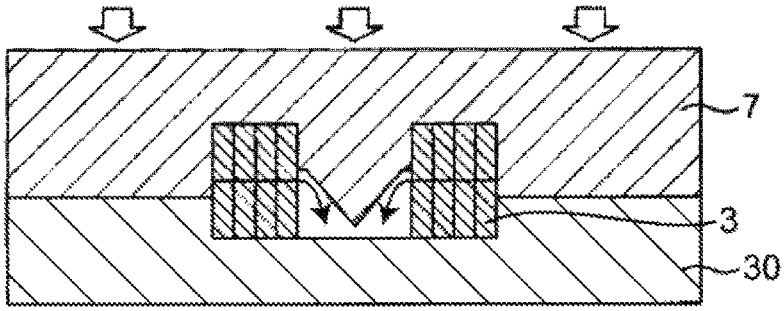

First, a plurality of coil conductors 3 is arranged in a mold 30. Next, a sheet of the magnetic layer 7 is placed on the coil conductors 3 followed by first pressing (FIG. 5A. By the first pressing, at least a part of the coil conductors 3 is embedded in the aforementioned sheet, and the interior of the coil conductors 3 is filled with a composite material (FIG. 5B.

Figure 5C:
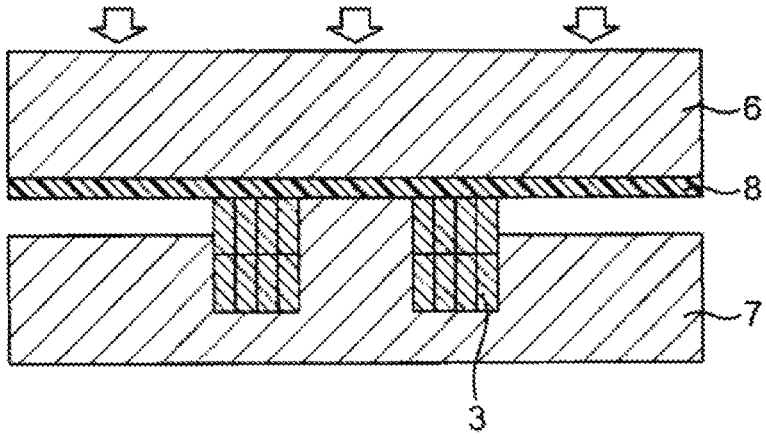

Next, the sheet in which the coil conductors 3 are embedded, which is obtained by the first pressing, is removed from the mold, and next a sheet of the non-magnetic layer 8 is placed on the surface on which the coil conductors 3 are exposed and furthermore a sheet of the magnetic layer 6 is placed thereon, followed by second pressing (FIG. 5C). Thus, a collective coil board including a plurality of base bodies can be obtained. The aforementioned three sheets are integrated through the second pressing, forming the body 2 of the coil component 1.

Note that the sheet that becomes the non-magnetic layer 8 and the sheet that becomes the magnetic layer 7 may be placed in this order on the coil conductors 3, followed by the first pressing, and the sheet of the magnetic body may be placed on the surface where the coil conductors 3 are exposed, followed by the second pressing. Alternatively, the sheet that becomes the non-magnetic layer 8 and the sheet that becomes the magnetic layer 7 may be placed in this order on the coil conductors 3, followed by the first pressing, and the sheet that becomes the non-magnetic layer 8 and the sheet that becomes the magnetic layer 7 may be placed on the surface where the coil conductors 3 are exposed such that the non-magnetic layer 8 is in contact with the coil conductors 3, followed by the second pressing.

Next, a collective coil board obtained through the second pressing is divided into base bodies. The terminal ends 14 and 15 of the coil conductor 3 are respectively exposed on the opposing end surfaces 23 and 24 of the resultant body.

Next, on predetermined points of the body 2, the outer electrodes 4 and 5 are formed by, for example, plating processing, preferably electrolytic plating processing.

In a preferable aspect, the aforementioned plating processing is performed after the surface of the body corresponding to the points where the outer electrodes are formed is irradiated with a laser beam. When the surface of the body is irradiated with a laser beam, at least a part of the resin material that forms the magnetic body portion is removed, and the metal particle is exposed. Thus, the electric resistance of the surface of the body is reduced, and it becomes easy to form plating. The non-magnetic layer does not generally include a conductive material, and therefore plating growth exceeding the non-magnetic layer can be suppressed. When the coil component is mounted on the board or the like, other components, e.g., the casing or the shield, are positioned thereon. This case is not preferable because there is a large possibility that short-circuit with respect to the shield or the like can occur when the outer electrodes are formed on the top surface. In the present aspect, the non-magnetic layer is exposed on the end surface to suppress plating growth over the top surface, enabling suppression of short-circuit with the shield or the like. Alternatively, in order to form the outer electrodes on the top surface, a non-magnetic ferrite is included in the non-magnetic layer and a laser beam is emitted to reduce the resistance of the non-magnetic ferrite, and thus the outer electrodes can be formed across the non-magnetic layer.

Thus, coil component 1 of the present disclosure is manufactured.

Moreover, the coil component of the present disclosure can be manufactured by a different method.

First, a magnetic base 31 (corresponding to the magnetic layer 6) including a protrusion 33 on the top surface is produced.

The magnetic base is produced such that a metal particle, a resin material, and as necessary other substances are mixed, the resultant mixture is press-molded in a mold, and the resultant press-molded body is heat-treated to solidify the resin material.

Figure 6A:
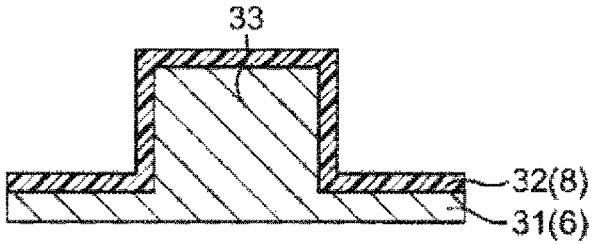
FIGS. 6A-6D are views for explaining another method for manufacturing a coil component of the present disclosure.

Next, the non-magnetic layer 32 is produced on the magnetic base 31 obtained in the above (FIG. 6A).

The aforementioned non-magnetic layer 32 may be directly formed on the aforementioned magnetic base 31, or a non-magnetic body sheet that is separately produced may be set on the magnetic base 31. A method for direct formation includes screen printing, spray coating, and photolithography.

Figure 6B:
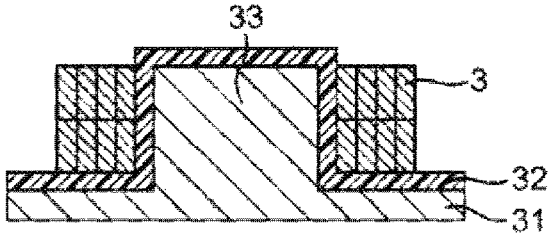

Next, the coil conductor is arranged on the magnetic base such that the protrusion 33 of the magnetic base 31 on which the non-magnetic layer is provided is positioned at the winding core portion of the coil conductor 3 (FIG. 6B).

As a method for arranging the coil conductor, the coil conductor obtained by separately winding the conductive wire may be arranged on the magnetic base or the conductive wire may be wound around the protrusion of the magnetic base to directly produce and arrange the coil conductor on the magnetic base.

Next, a magnetic outer coating 34 (corresponding to the magnetic layer 7) is produced.

The metal particle, the resin material, and as necessary other substances are mixed. A solvent is added to the resultant mixture to adjust the viscosity to an appropriate viscosity to obtain a material for forming the magnetic outer coating.

Figure 6C:
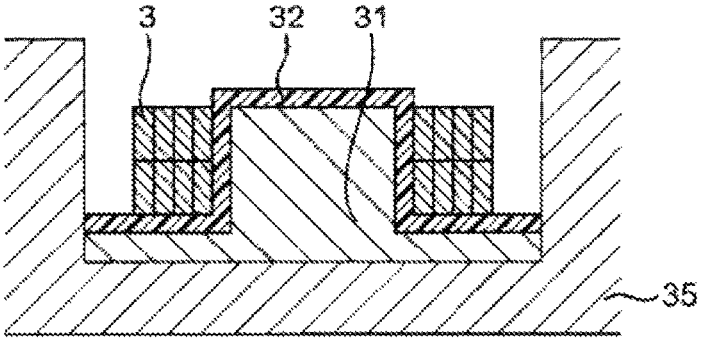
Figure 6D:
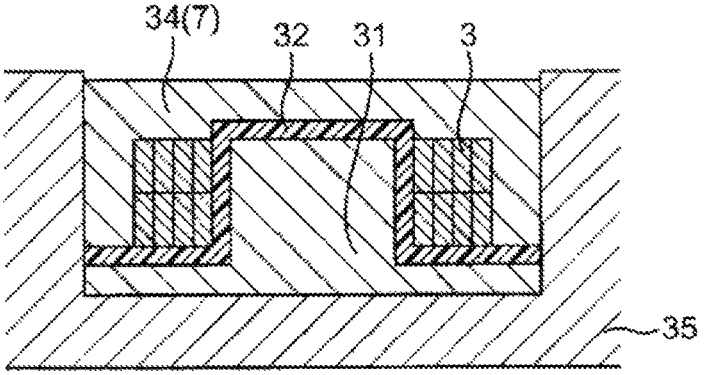

The magnetic base on which the coil conductor obtained in the above is arranged in a mold 35 (FIG. 6C). Next, the material for forming the magnetic outer coating obtained in the above is poured into the mold followed by pressure-molding (FIG. 6D). Then, the pressure-molded body is heat-treated to solidify the resin material to form the magnetic outer coating, and thus the body 2 in which the coil conductor is embedded is obtained.

Next, on predetermined points of the body 2, the outer electrodes 4 and 5 are formed by, for example, plating processing, preferably electrolytic plating processing.

Thus, the coil component of the present disclosure is manufactured.

As illustrated in FIGS. 6A-6D, the non-magnetic layer 32 may be present to separate the coil conductor 3 and the bottom surface of the body. Moreover, the non-magnetic layer 32 may be present between the coil conductor 3 and the magnetic base 31 at the winding core portion.

Note that the method for manufacturing the coil component of the present disclosure is not limited to the aforementioned two manufacturing methods, but manufacturing may be performed by a method partially different from the aforementioned manufacturing methods, or another method.

The coil component of the present disclosure is described above, but the present disclosure is not limited to the aforementioned embodiment, and a design change may be made without departing from the gist of the present disclosure.

For example, in the coil component 1 of the aforementioned embodiment, each of the magnetic layers 6 and 7 is formed of a single layer, but may be a stack of a plurality of magnetic body sheets.

Figure 7:
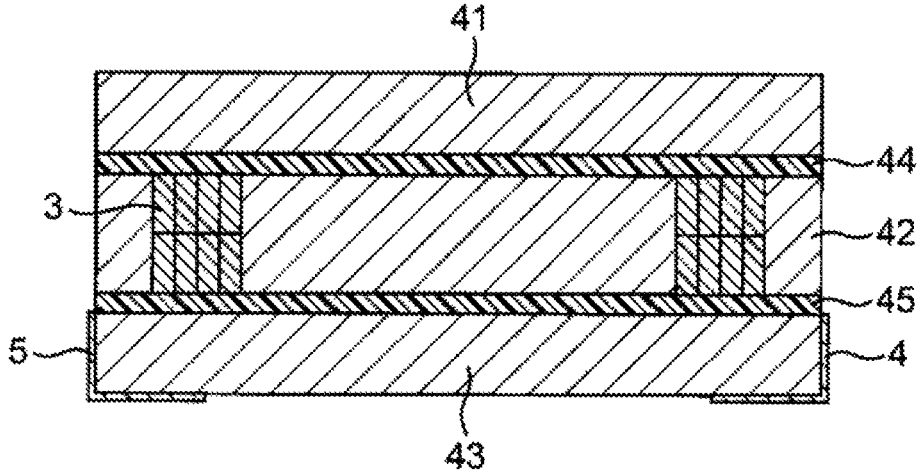
FIG. 7 is a cross-sectional view schematically illustrating a cross-section parallel to an LT plane of the coil component of the present disclosure according to another aspect.
Figure 8:
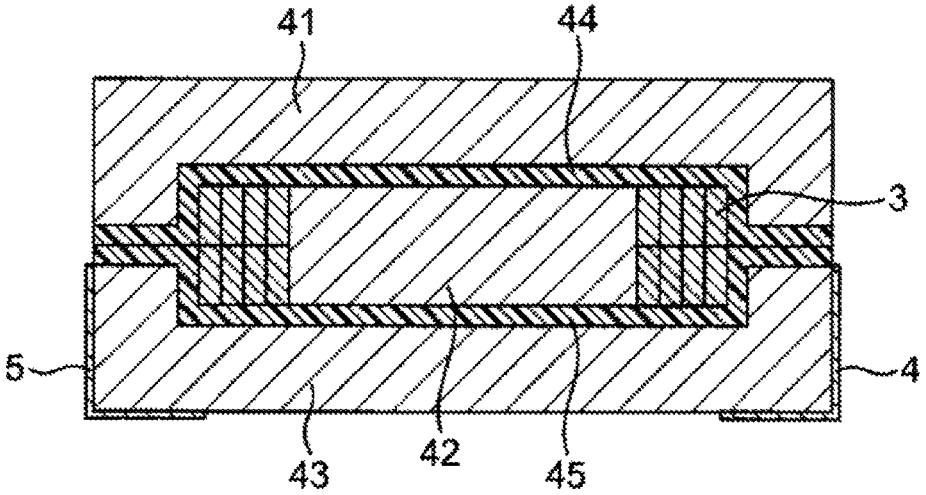
FIG. 8 is a cross-sectional view schematically illustrating a cross-section parallel to an LT plane of the coil component of the present disclosure according to another aspect.

The coil component 1 of the aforementioned embodiment includes one non-magnetic layer 8, but two or more non-magnetic layers 8 may be present. For example, as illustrated in FIG. 7, the coil component of the present disclosure may include three magnetic layers 41, 42 and 43 and two non-magnetic layers 44 and 45, and the coil conductor 3 and the magnetic layer 42 between the two non-magnetic layers 44 and 45. Moreover, in another aspect, as illustrated in FIG. 8, the aforementioned two non-magnetic layers 44 and 45 may be arranged to vertically sandwich the coil and may be in close contact on the side surface side of the coil conductor.

The present disclosure discloses, but is not particularly limited to, aspects below.

1. A coil component comprising a body and a coil conductor embedded in the body, wherein the body includes a magnetic layer and a non-magnetic layer. The magnetic layer is formed of a composite material including a metal particle and a resin material, and the non-magnetic layer is arranged to block between at least one of top and bottom surfaces of the body and the coil conductor.

2. The coil component according to the aforementioned aspect 1, wherein the non-magnetic layer is arranged to contact an end surface of the coil conductor.

3. The coil component according to the aforementioned aspect 1 or 2, wherein the non-magnetic layer is present by going round a side surface side from an end surface side of the coil conductor.

4. The coil component according to the aforementioned aspect 3, wherein the non-magnetic layer goes round to half in a length direction of a side surface of a coil conductor.

5. The coil component according to any one of the aforementioned aspects 1 to 4, wherein a part of the non-magnetic layer is positioned between a side surface of the coil conductor and a side surface of the body, and an average thickness of a non-magnetic layer on a coil conductor side in a case where a non-magnetic layer between a side surface of the coil conductor and a side surface of a body is divided into two is larger than an average thickness of a non-magnetic layer on a side surface side of a body.

6. The coil component according to any one of the aforementioned aspects 1 to 5, wherein a distance from a top surface of the body to one end surface of a coil conductor is equal to a distance from a bottom surface of the body to an other end surface of a coil conductor.

7. The coil component according to any one of the aforementioned aspects 1 to 6, further comprising an outer electrode on a bottom surface of the body, wherein the non-magnetic layer is positioned between a top surface and a coil conductor.

8. The coil component according to any one of the aforementioned aspects 1 to 6, wherein the coil conductor is an α-wound coil, and the non-magnetic layer is arranged substantially parallel to an end surface of the coil conductor.

9. The coil component according to any one of the aforementioned aspects 1 to 7, wherein the coil conductor is a coil conductor obtained when a flat wire is α-wound, and the non-magnetic layer is arranged substantially perpendicularly to a width direction of a flat wire.

10. The coil component according to any one of the aforementioned aspects 1 to 9, wherein the coil conductor is an edgewise-wound coil, and the non-magnetic layer is arranged to surface-contact a main surface of a flat wire that forms a coil conductor on an end surface of the coil conductor.

11. The coil component according to any one of the aforementioned aspects 1 to 10, wherein the non-magnetic layer includes a resin material and a non-magnetic inorganic material.

12. The coil component according to the aforementioned aspect 11, wherein the non-magnetic inorganic material is selected from silica, alumina, silicon oxide, and a non-magnetic ferrite.

EXAMPLE

A sheet that becomes the magnetic layer including Fe-containing alloy powder and epoxy resin, a sheet that becomes the non-magnetic layer including alumina and epoxy resin, and a coil conductor of a winding formed of a flat wire were prepared. Then, on the coil conductor, the sheet that becomes the magnetic layer was placed followed by first pressing, the sheet that becomes the non-magnetic layer was placed on the surface where the coil conductor was exposed, and furthermore the sheet that becomes the magnetic layer was placed thereon followed by second pressing. Then, the resin of the sheet after the second pressing was solidified to form a body in which the non-magnetic layer was arranged to separate the top surface and the coil conductor. Then, a part of the bottom surface and the end surface of the body are irradiated with a laser beam to melt the metal magnetic powder on the surface followed by plating so as to form the coil component of the example.

Comparative Example

The coil component of the comparative example was formed in the same way as the example except that all the sheets were the sheet that becomes the magnetic layer instead of the sheet that becomes the non-magnetic layer.

(Evaluation Method)

Figure 9:
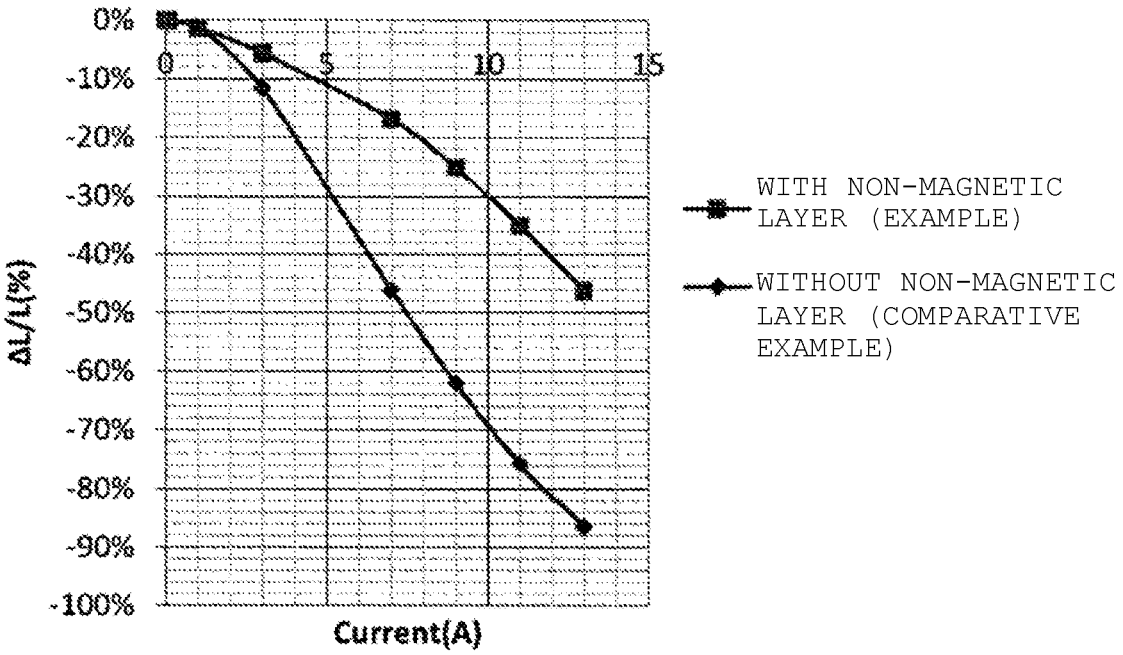
FIG. 9 is a graph illustrating a simulation result of a coil component of the present disclosure.

A simulation was performed with magnetic field analysis software to compare an example including the non-magnetic layer and a comparative example not including the non-magnetic layer for a current value at the time when the L value became a value of 70% of the initial value (i.e., current value in the case of $\Delta L/L=-30\%$ in FIG. 9). A component on which the simulation was performed had a size of 1.6×0.8×0 8 mm, and the non-magnetic layer was inserted to contact the α-wound coil. Results of the simulation are illustrated in FIG. 9 and Table 1.

TABLE 1

| | Current value in case where L value is value of 70% of initial value (A) |
|---|---|
| Example | 5.1 |
| Comparative Example | 9.9 |

Moreover, the bending strengths of the example including the non-magnetic layer and the comparative example not including the non-magnetic layer were measured and compared. The bending strength was a pressure at the time of snapping when the pressure was applied from the top surface of the coil component. Table 1 indicates average values measured for two points in the example and three points in the comparative example.

TABLE 2

| | Bending strength [kN] |
|---|---|
| Example (with non-magnetic layer) | 227 |
| Comparative Example (without non-magnetic layer) | 91.5 |

(Results)

As can be seen from Table 1, in the example, the current value at which the L value becomes a value of 70% or less of the initial value is higher than that of the comparative example, showing improvement in DC superposition characteristics. Moreover, as can be seen from Table 2, use of the non-magnetic layer including the resin material and the non-magnetic inorganic material considerably increases the bending strength.

The coil component of the present disclosure can be used as an inductance or the like for a wide variety of purposes.

What is claimed is:

1. A coil component comprising a body and a coil conductor embedded in the body, wherein the body includes a magnetic layer and a non-magnetic layer, the magnetic layer is made of a composite material including a metal particle and a resin material, and the non-magnetic layer is arranged to block between the coil conductor and at least one of a top surface and a bottom surface of the body such that no coil conductor is arranged on at least one side of the non-magnetic layer in the thickness direction.

2. The coil component according to claim 1, wherein the non-magnetic layer is in contact with an end surface of the coil conductor.

3. The coil component according to claim 2, wherein the non-magnetic layer is arranged around a side surface of the coil conductor from an end surface of the coil conductor.

4. The coil component according to claim 2, wherein a distance from the top surface of the body to one end surface of the coil conductor is equal to a distance from the bottom surface of the body to another end surface of the coil conductor.

5. The coil component according to claim 2, further comprising an outer electrode on the bottom surface of the body, wherein the non-magnetic layer is located between the top surface of the body and the coil conductor.

6. The coil component according to claim 2, wherein the coil conductor is an α-wound coil, and the non-magnetic layer is arranged substantially parallel to an end surface of the coil conductor.

7. The coil component according to claim 2, wherein the coil conductor is a coil conductor obtained such that a flat wire is α-wound, and the non-magnetic layer is arranged substantially perpendicular to a width direction of the flat wire.

8. The coil component according to claim 2, wherein the coil conductor is an edgewise-wound coil, and the non-magnetic layer is in surface-contact with a main surface of a flat wire that defines the coil conductor on an end surface of the coil conductor.

9. The coil component according to claim 2, wherein the non-magnetic layer includes a resin material and a non-magnetic inorganic material.

10. The coil component according to claim 1, wherein the non-magnetic layer is arranged around a side surface of the coil conductor from an end surface of the coil conductor.

11. The coil component according to claim 10, wherein the non-magnetic layer is arranged around half of the side surface of the coil conductor in a length direction.

12. The coil component according to claim 1, wherein a distance from the top surface of the body to one end surface of the coil conductor is equal to a distance from the bottom surface of the body to another end surface of the coil conductor.

13. The coil component according to claim 1, further comprising an outer electrode on the bottom surface of the body, wherein the non-magnetic layer is located between the top surface of the body and the coil conductor.

14. The coil component according to claim 1, wherein the coil conductor is an α-wound coil, and the non-magnetic layer is arranged substantially parallel to an end surface of the coil conductor.

15. The coil component according to claim 1, wherein the coil conductor is a coil conductor obtained such that a flat wire is α-wound, and the non-magnetic layer is arranged substantially perpendicular to a width direction of the flat wire.

16. The coil component according to claim 1, wherein the coil conductor is an edgewise-wound coil, and the non-magnetic layer is in surface-contact with a main surface of a flat wire that defines the coil conductor on an end surface of the coil conductor.

17. The coil component according to claim 1, wherein the non-magnetic layer includes a resin material and a non-magnetic inorganic material.

18. The coil component according to claim 17, wherein the non-magnetic inorganic material comprises at least one selected from the group consisting of silica, alumina, silicon oxide, and a non-magnetic ferrite.

19. A coil component comprising a body and a coil conductor embedded in the body, wherein the body includes a magnetic layer and a non-magnetic layer, the magnetic layer is made of a composite material including a metal particle and a resin material, the non-magnetic layer is arranged to block between the coil conductor and at least one of a top surface and a bottom surface of the body, a portion of the non-magnetic layer is located between a side surface of the coil conductor and a side surface of the body, and in a case where the non-magnetic layer between the side surface of the coil conductor and the side surface of the body is divided into two, an average thickness of the non-magnetic layer on the side surface side of the coil conductor is larger than an average thickness of the non-magnetic layer on the side surface side of the body.

20. A coil component comprising a body and a coil conductor embedded in the body, wherein the body includes a magnetic layer and a non-magnetic layer, the magnetic layer is made of a composite material including a metal particle and a resin material, the non-magnetic layer is arranged to block between the coil conductor and at least one of a top surface and a bottom surface of the body, the non-magnetic layer is in contact with an end surface of the coil conductor, a portion of the non-magnetic layer is located between a side surface of the coil conductor and a side surface of the body, and in a case where the non-magnetic layer between the side surface of the coil conductor and the side surface of the body is divided into two, an average thickness of the non-magnetic layer on the side surface side of the coil conductor is larger than an average thickness of the non-magnetic layer on the side surface side of the body.

* * * * *